US006272952B1

(12) United States Patent
Hsu et al.

(10) Patent No.: US 6,272,952 B1
(45) Date of Patent: Aug. 14, 2001

(54) DOUBLE-REVERSIBLE SCREWDRIVER AND WRENCH COMBINATION HAND TOOL

(76) Inventors: Yu-Tu Hsu; Chang Hsueh-O Hsu, both of 245, Guang Ming Road, Dah Jea Cheng, Taichung Hsien (TW)

( * ) Notice: Subject to any disclaimer, the term of this patent is extended or adjusted under 35 U.S.C. 154(b) by 0 days.

(21) Appl. No.: 09/568,029

(22) Filed: May 10, 2000

(51) Int. Cl.[7] ..... B25B 17/00

(52) U.S. Cl. ..... 81/57.22; 81/63.1; 81/57.28; 81/57.29; 7/138

(58) Field of Search ..... 81/57.22, 63.1, 81/57.28, 57.29, 57.32, 57.36, 437, 438, 439; 7/138, 165

(56) References Cited

U.S. PATENT DOCUMENTS 4,474,089 * 10/1984 Scott .
4,947,942 * 8/1990 Lightle et al. .
4,960,016 * 10/1990 Seals .
6,125,721 * 10/2000 Yang .

* cited by examiner

*Primary Examiner*—Timothy V. Eley
*Assistant Examiner*—Willie Berry, Jr.

(74) *Attorney, Agent, or Firm*—Birch, Stewart, Kolasch & Birch, LLP

(57) ABSTRACT

A double-reversible screwdriver and wrench combination hand tool constructed to include: a handle, a main body fastened to one end of the handle, the main body comprising a rear coupling end fastened to the handle, a front end terminating in a T-tube formed of a longitudinal tube and a transverse tube, and a receiving chamber on the middle between the rear coupling end and the front end, a longitudinal spindle mounted in the longitudinal tube, the longitudinal spindle having a rear end terminating in a fixed ratchet wheel suspended inside the main body, and a front end terminating in a coupling portion and disposed outside the longitudinal tube, a coupling socket coupled to the coupling portion of the longitudinal spindle to hold a screwdriver bit, enabling the screwdriver bit to be rotated with the longitudinal spindle, a first bevel gear suspended in the receiving chamber inside the main body and rotated with the longitudinal spindle, a transverse spindle mounted in the transverse tube and rotated with the longitudinal spindle, the transverse spindle having a front coupling rod extended out of the transverse tube for holding a wrench socket for turning screw bolts and nuts, a second bevel gear fixedly provided at a rear end of the transverse spindle and meshed with the first bevel gear for synchronous rotary motion with the longitudinal spindle, and double-reversible control mechanism provided in the main body and operated to control forward/reverse rotation of the longitudinal spindle relative to the main body.

13 Claims, 13 Drawing Sheets

DOUBLE-REVERSIBLE SCREWDRIVER AND WRENCH COMBINATION HAND TOOL

BACKGROUND OF THE INVENTION

The present invention relates to a screwdriver and wrench combination hand tool, and more particularly to such a screwdriver and wrench combination hand tool, which comprises a double-reversible screwdriver and a wrench.

Screwdriver and wrench are commonly used hand tools. However, these two hand tools are provided for different purposes, i.e., a screwdriver, as shown in FIG. 1, is designed for turning screws, and a wrench, as shown in FIG. 2, is designed for turning bolts and nuts. The screwdriver shown in FIG. 1 is a double-reversible screwdriver. This structure of double-reversible screwdriver, as shown in FIGS. 1 and 3, is generally comprised of a handle 1, a ratchet holder 2, a ratchet wheel 3, two movable stop plates 401 and 402, a plastic slide 5, a retainer plate 6, a metal protective sleeve 7, and a screwdriver bit 8. The ratchet holder 2, the ratchet wheel 3, the movable stop plates 401 and 402, and the slide 5 form a double-reversible control mechanism for controlling the direction of rotation of the screwdriver bit 8. The stop plates 401 and 402 are respectively mounted at front and rear ends in a receiving chamber 201 in the ratchet holder 2 at two opposite sides of the ratchet wheel 3. Because the stop plates 401 and 402 are respectively mounted at the front and rear ends in the receiving chamber 201 in the ratchet holder 2, the receiving chamber 201 has a certain length, which limits the installation of wrench means to provide an added function to the double-reversible screwdriver. Further, the plate slide 5 has positioning blocks 501 secured to a notched sliding slot 701 in the metal protective sleeve 7. The slide 5 wears quickly with use because positioning blocks 501 are frequently rubbed against the peripheral edge of the notched sliding slot 701. When the slide 5 begins to wear, it can no longer positively positioned in the notched sliding slot 701.

SUMMARY OF THE INVENTION

The present invention has been accomplished under the circumstances in view. It is the main object of the present invention to provide a double-reversible screwdriver and wrench combination tool, which combines a double-reversible screwdriver and a wrench into a handy hand tool. It is another object of the present invention to provide a double-reversible screwdriver and wrench combination hand tool, which is durable and practical in use. According to one aspect of the present invention, the double-reversible screwdriver and wrench combination hand tool comprises: a handle, a main body fastened to one end of the handle, the main body comprising a rear coupling end fastened to the handle, a front end terminating in a T-tube formed of a longitudinal tube and a transverse tube, and a receiving chamber on the middle between the rear coupling end and the front end, a longitudinal spindle mounted in the longitudinal tube, the longitudinal spindle having a rear end terminating in a fixed ratchet wheel suspended inside the main body, and a front end terminating in a coupling portion and disposed outside the longitudinal tube, a coupling socket coupled to the coupling portion of the longitudinal spindle to hold a screwdriver bit, enabling the screwdriver bit to be rotated with the longitudinal spindle, a first bevel gear suspended in the receiving chamber inside the main body and rotated with the longitudinal spindle, a transverse spindle mounted in the transverse tube and rotated with the longitudinal spindle, the transverse spindle having a front coupling rod extended out of the transverse tube for holding a wrench socket for turning screw bolts and nuts, a second bevel gear fixedly provided at a rear end of the transverse spindle and meshed with the first bevel gear for synchronous rotary motion with the longitudinal spindle, and double-reversible control mechanism provided in the main body and operated to control forward/reverse rotation of the longitudinal spindle relative to the main body. According to another aspect of the present invention, the longitudinal tube and the transverse tube each have an inner thread, and two screw plugs are respectively threaded into the inner thread in the longitudinal tube and the transverse tube to hold the longitudinal spindle and the transverse spindle in place. According to still another aspect of the present invention the double-reversible control mechanism comprises a ratchet wheel fixedly mounted on the longitudinal spindle, a first stop means and a second stop means bilaterally mounted inside the receiving chamber and respectively forced into engagement with the ratchet wheel to stop the ratchet wheel from rotary motion, a holding down spring plate mounted in the main body to hold down the first stop means and the second stop means, and a rotary wheel mounted on the main body and rotated between a first position where said first stop means is released from said ratchet wheel and said second stop means is maintained engaged with said ratchet wheel for enabling said ratchet wheel to be rotated clockwise relative to said main body, a second position where the second stop means is released from the ratchet wheel and the first stop means is maintained engaged with the ratchet wheel for enabling the ratchet wheel to be rotated counterclockwise relative to the main body, and a third position where the first stop means and the second stop means are maintained engaged with the ratchet wheel to stop the ratchet wheel from rotary motion relative to the main body, the rotary wheel having a projecting rod for moving the first stop means and the second stop means upon rotary motion of the rotary wheel on the main body. According to still another aspect of the present invention, the first bevel gear comprises a coupling hole coupled to the ratchet wheel for enabling the longitudinal spindle to be rotated with the first bevel gear. According to still another aspect of the present invention, a spring is mounted on the transverse spindle and stopped between the second bevel gear and the screw plug in the transverse tube to force the second bevel gear into engagement with the first bevel gear. According to still another aspect of the present invention, the holding down spring is fastened to an invertedly extended L-shaped holder inside the receiving chamber. According to still another aspect of the present invention, the holding down spring comprises positioning flange means secured to a broad area in the receiving chamber. According to still another aspect of the present invention, the double-reversible control mechanism further comprises three recessed locating holes equiangularly provided at the rotary wheel, a spring element mounted in a recessed hole on the main body, and a steel ball supported on the spring element and forced by the spring element into engagement with one of the recessed locating holes to hold the rotary wheel in one of the first position, second position and third position. According to still another aspect of the present invention, a first shell and a second shell are sealed together and covered on the T-tube of the main body, and a cylindrical third shell is coupled to the first shell and the second shell and rotated on the main body, the third shell having an inside projection engaged into a locating groove on the rotary wheel for enabling the rotary wheel to be rotated with the third shell. According to still another aspect of the present invention, the receiving chamber of the main body has a bottom wall sloping downwards from an outer side thereof toward the center thereof, and the first top means and the second stop means are tilted and perpendicularly forced into engagement with sloping teeth of the ratchet wheel. According to still another aspect of the present invention, the holding down spring is mounted in an outside annular groove at the periphery of the main body, having two protruding pressure strips for pressing on the first stop means and the second stop means respectively. According to still another aspect of the present invention, the main body can be made having at least two transverse tubes, each receiving a respective transverse spindle for synchronous rotation with the first bevel gear for turning screw bolts and nuts of different specifications.

DETAILED DESCRIPTION OF THE PREFERRED EMBODIMENT

Figure 1:
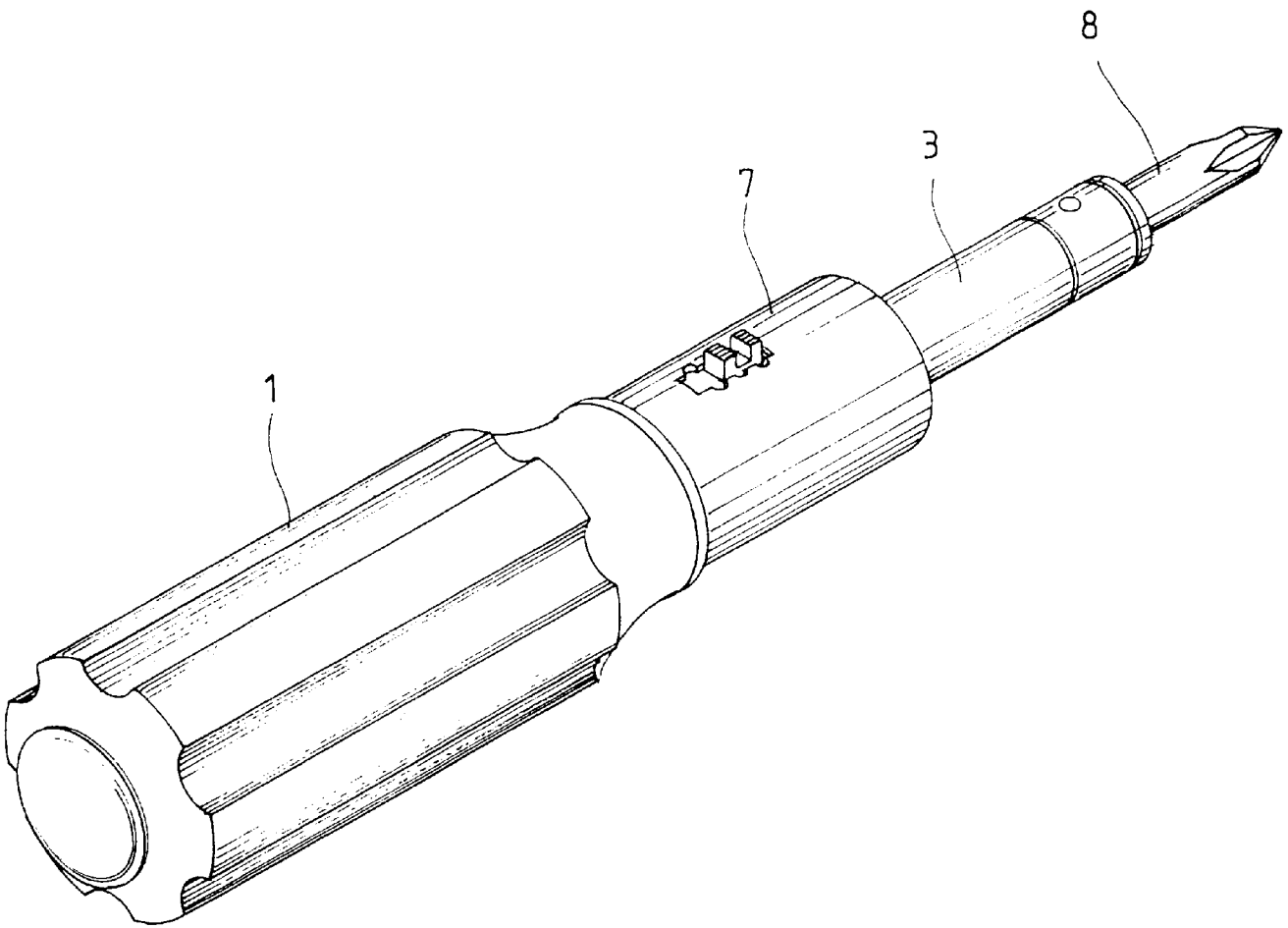
FIG. 1 (PRIOR ART)
FIG. 1 is a perspective view of a double-reversible screwdriver according to the prior art.
Figure 2:
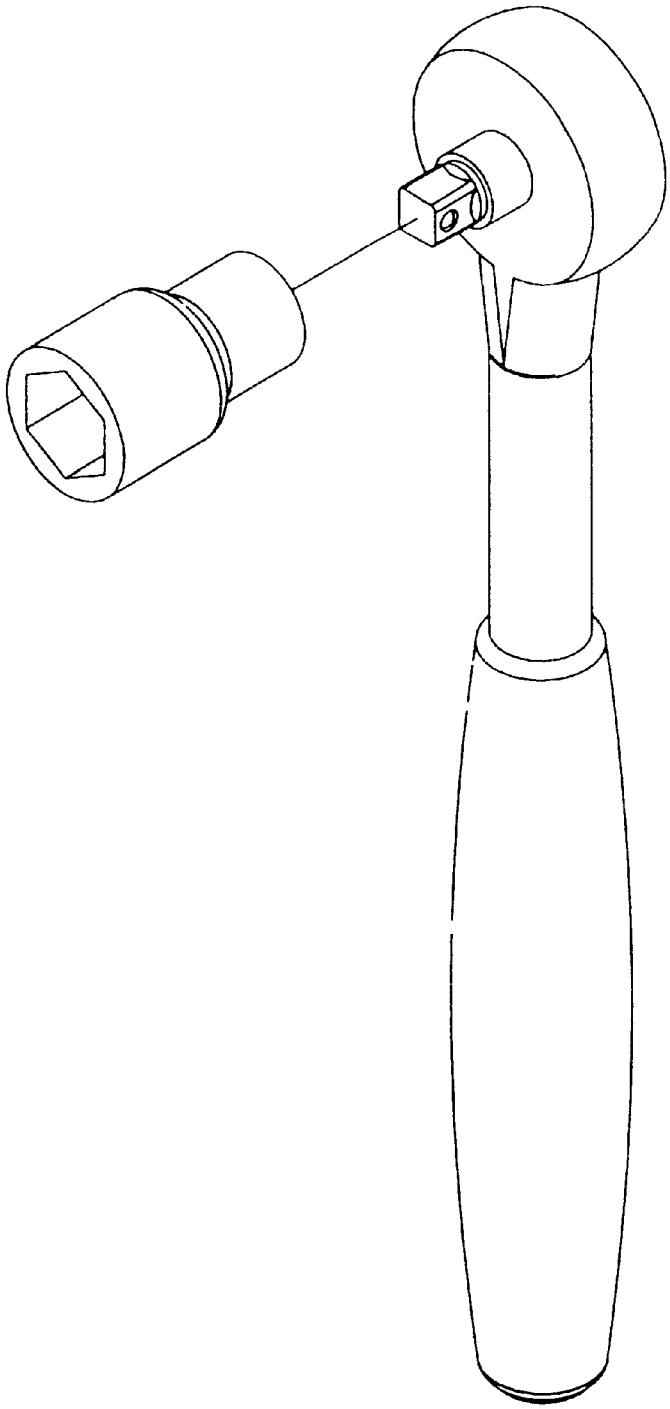
FIG. 2 ( PRIOR ART )
FIG. 2 is a perspective view of a conventional wrench.
Figure 3:
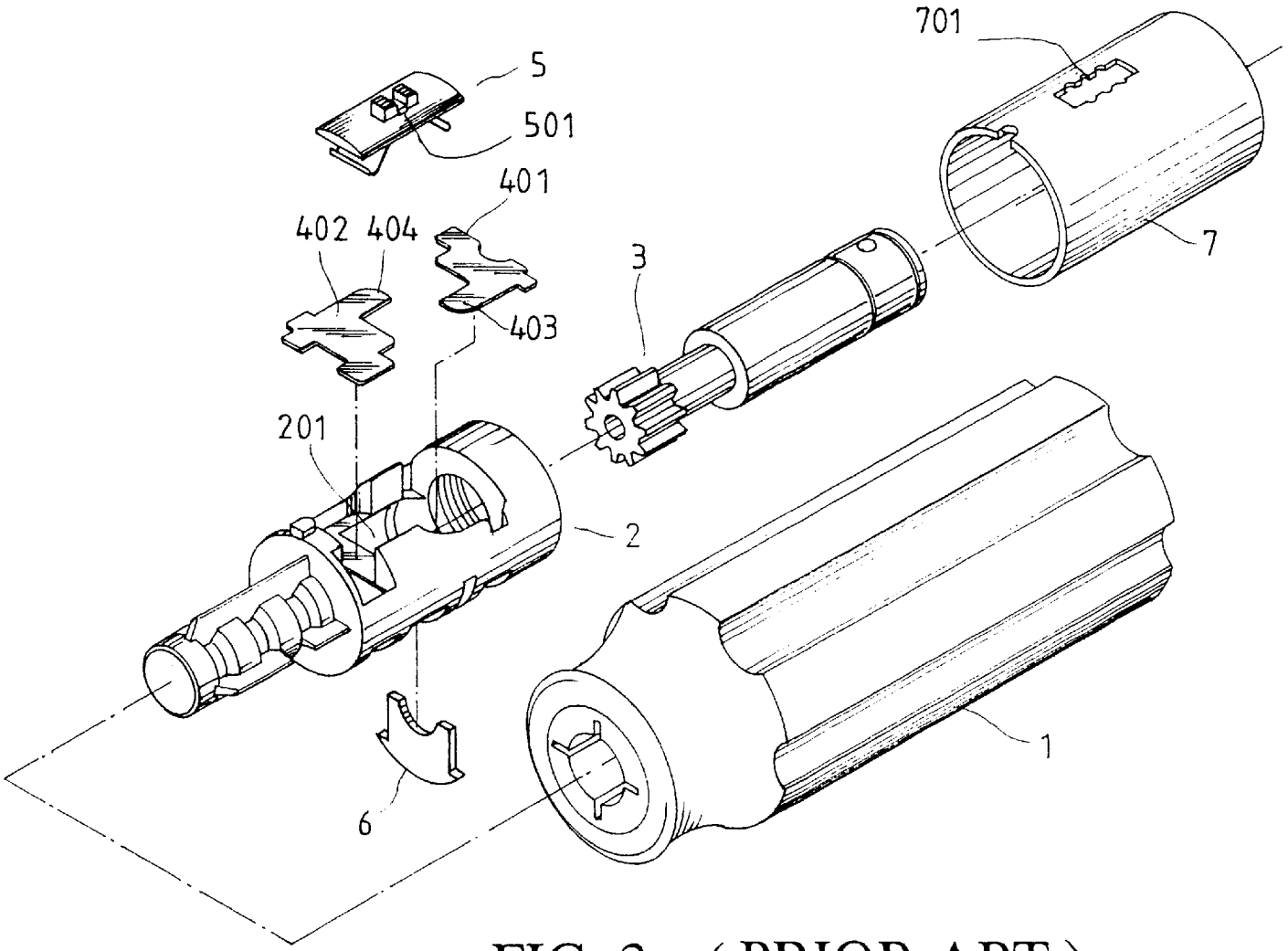
FIG. 3 (PRIOR ART)
FIG. 3 is an exploded view of the double-reversible screwdriver shown in FIG. 1.
Figure 4:
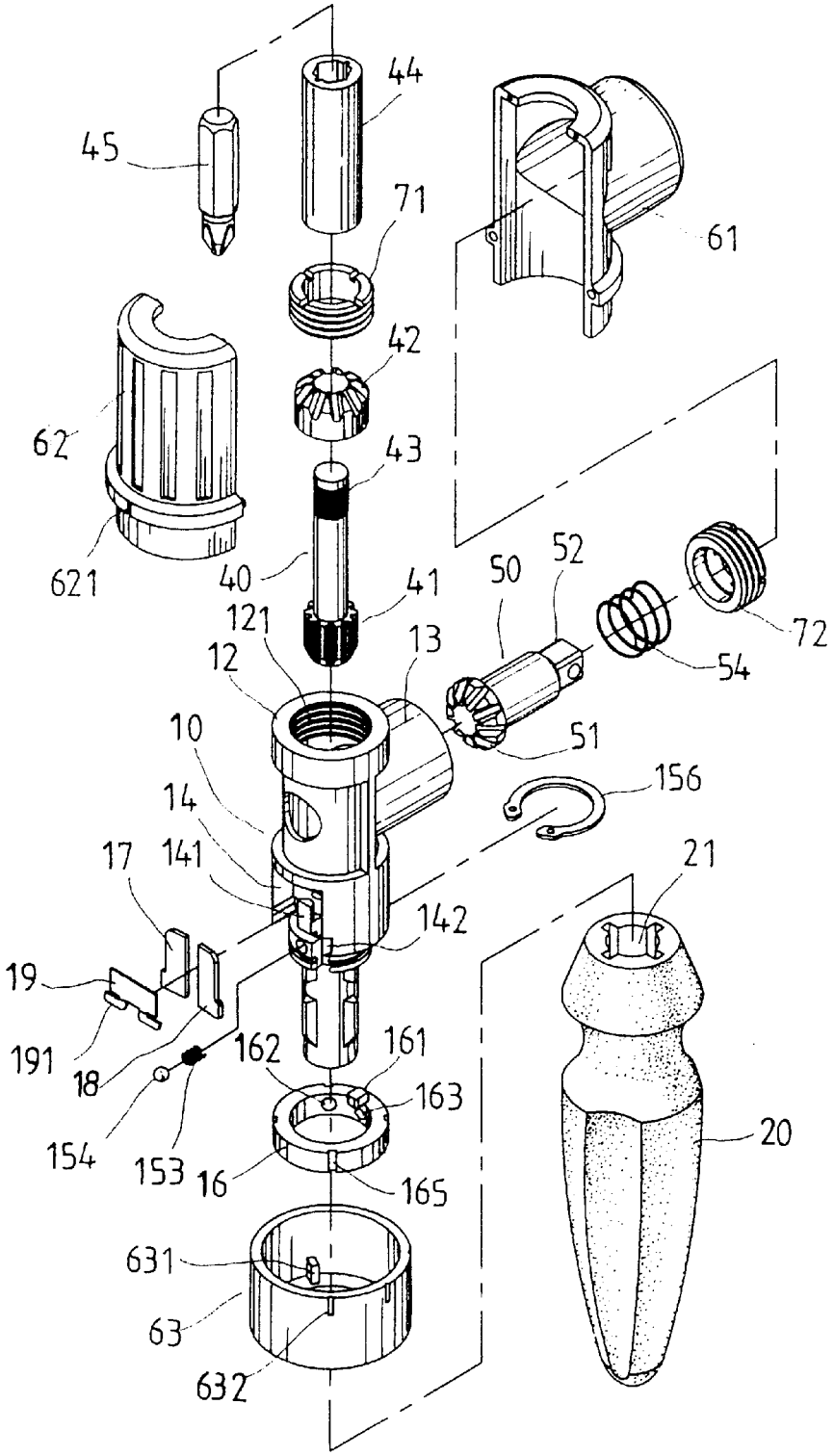
FIG. 4 is an exploded view of a double-reversible screwdriver and wrench combination hand tool according to the present invention.
Figure 5:
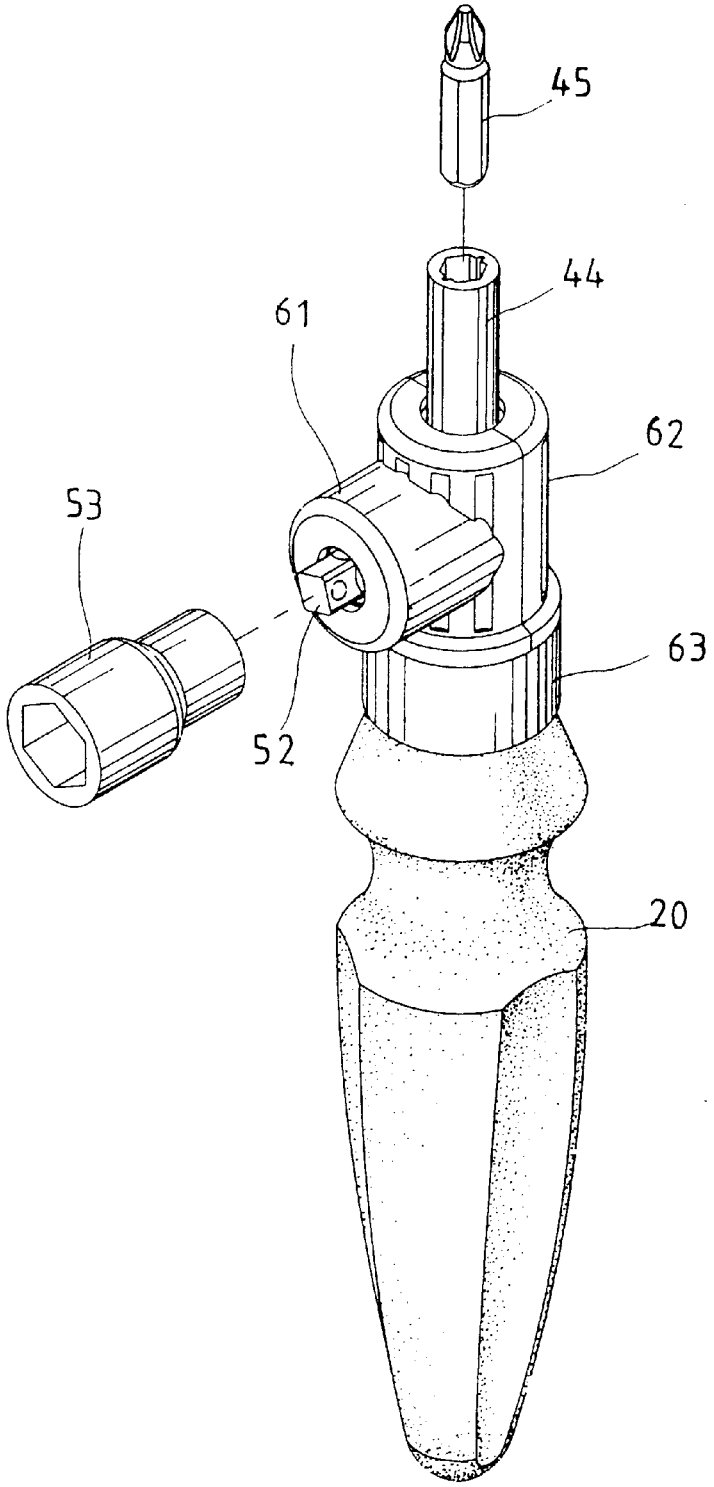
FIG. 5 is an assembly view of the double-reversible screwdriver and wrench combination hand tool shown in FIG. 4.

Referring to FIGS. 4 and 5, a double-reversible screwdriver and wrench combination hand tool is shown comprised of a main body 10, a handle 20, a double-reversible control mechanism 30, a longitudinal spindle 40, a transverse spindle 50, a set of shells 61, 62 and 63, two screw plugs 71 and 72, a coupling socket 44, and a screwdriver bit 45. The main body 10 has a rear coupling end 11 inserted into a coupling hole 21 on the handle 20 and secured thereto, and a front end terminating in a T-tube formed of a longitudinal tube 12 and a transverse tube 13. The tubes 12 and 13 have a respective inner thread 121 or 131. The screw plugs 71 and 72 are respectively threaded into the inner threads 121 and 131 in the tubes 12 and 13, to secure the longitudinal spindle 40 and the transverse spindle 50 to the T-tube of the main body 10.

Figure 6:
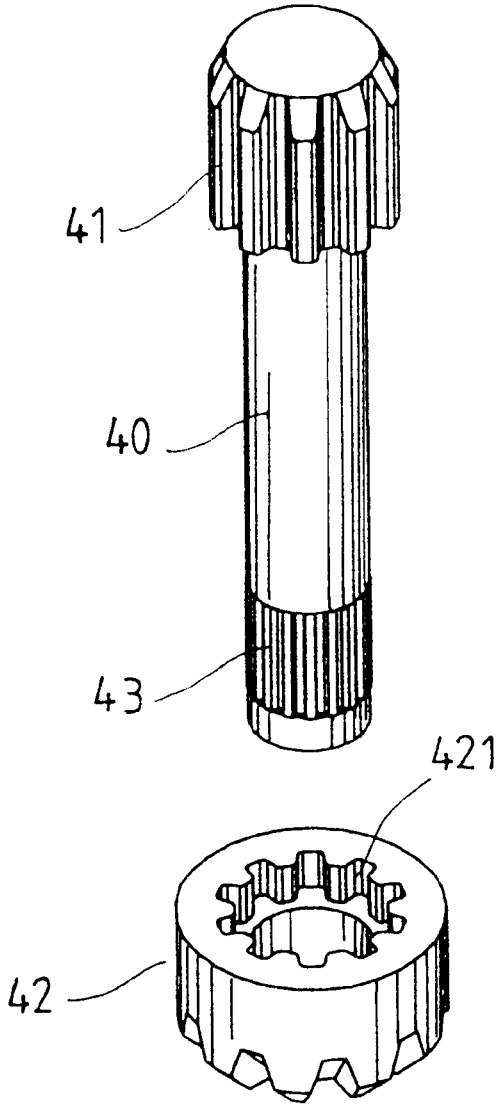
FIG. 6 illustrates the relationship between the longitudinal spindle and the corresponding bevel gear according to the present invention.
Figure 7:
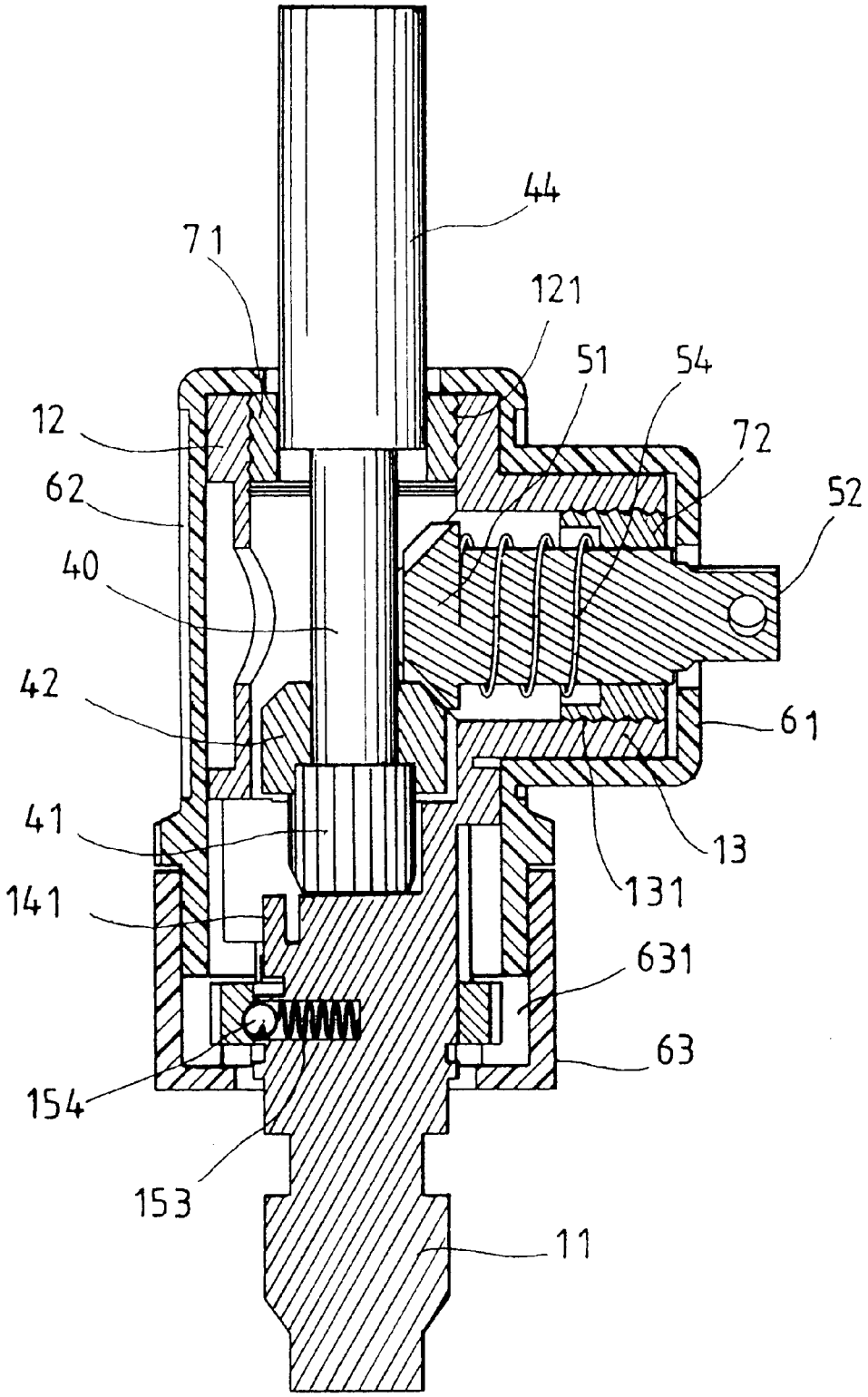
FIG. 7 is a sectional view of the double-reversible screwdriver and wrench combination hand tool according to the present invention.

Referring to FIGS. 6 and 7 and FIGS. 4 and 5 again, the longitudinal spindle 40 has a rear end terminating in a fixed ratchet wheel 41 suspended inside the main body 10, and a front end terminating in a coupling portion 43 and suspended outside the main body 10. The coupling socket 44 is coupled to the coupling portion 43 of the longitudinal spindle 40 to hold a screwdriver bit 45, enabling the screwdriver bit 45 to be rotated with the longitudinal spindle 40. A bevel gear 42 is mounted inside the main body 10 and coupled to the fixed ratchet wheel 41. The bevel gear 42 comprises a coupling hole 421 coupled to the fixed ratchet wheel 41 for enabling the longitudinal spindle 40 to be rotated with the bevel gear 42. The transverse spindle 50 has a rear end terminating in a bevel gear 51 meshed with the bevel gear 42 at the longitudinal spindle 40, and a front end terminating in a coupling rod 52 for holding a wrench socket 53. A spring 54 is mounted on the transverse spindle 50 and stopped between the bevel gear 51 and the screw plug 72. The spring 54 imparts a pressure to the bevel gear 51 of the transverse spindle 50, causing the bevel gear 51 to be maintained meshed with the bevel gear 42.

Figure 13:
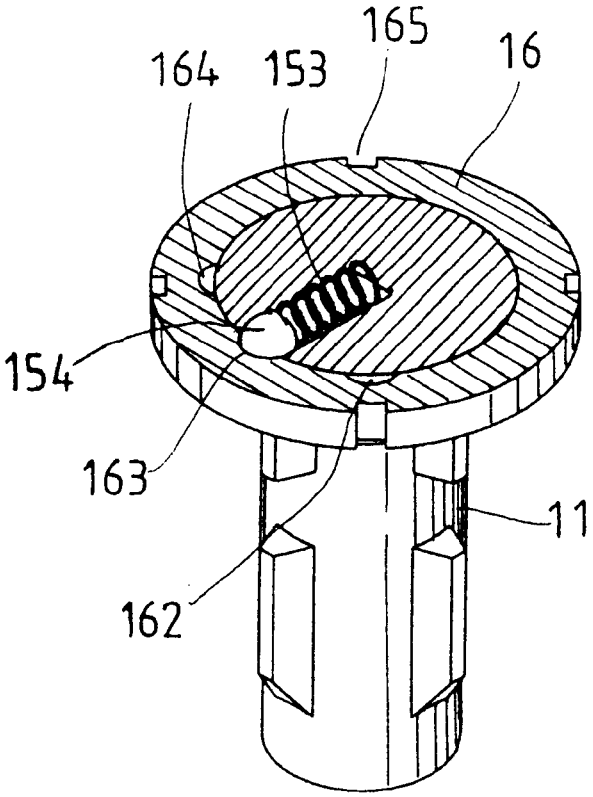
FIG. 13 is a perspective view in an enlarged scale of a part of the present invention, showing the internal structure of the rotary wheel.
Figure 8:
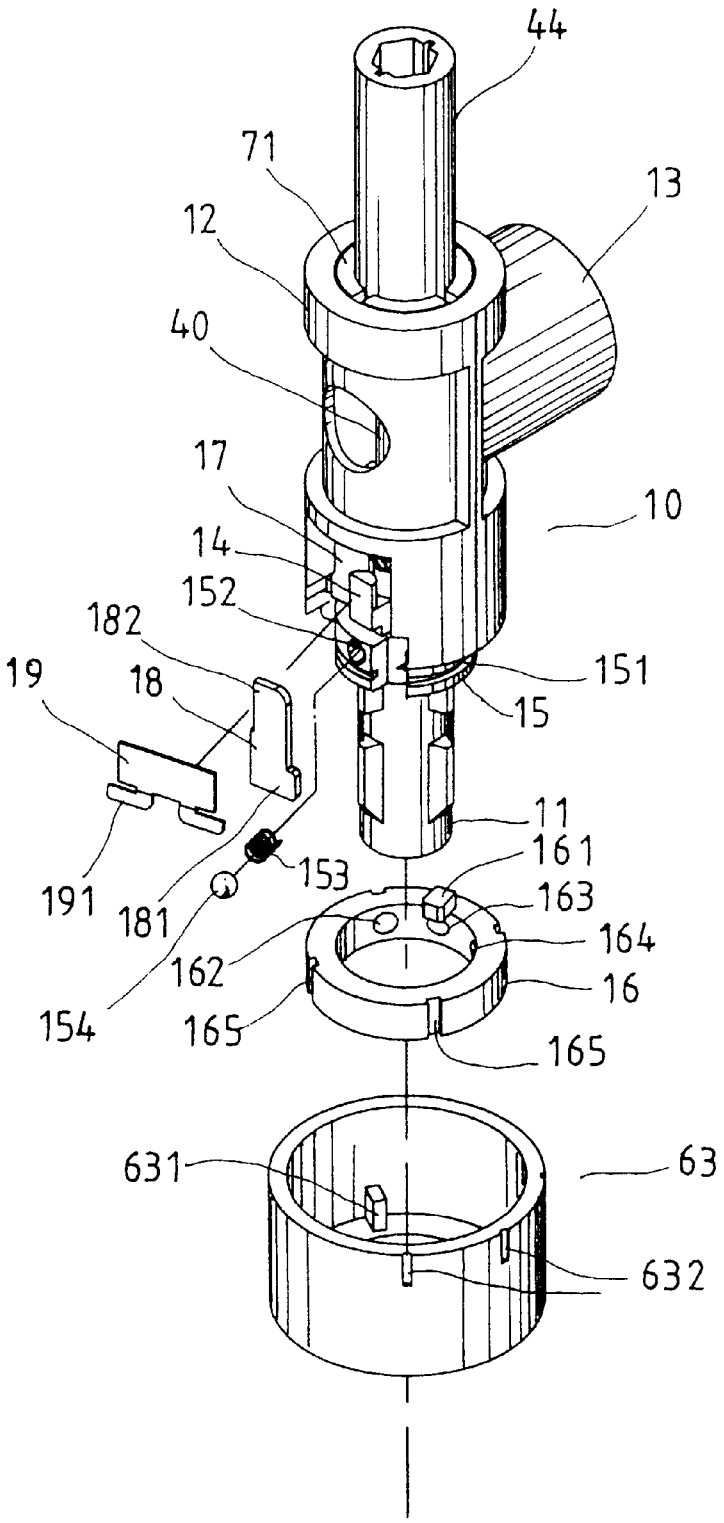
FIG. 8 is an exploded view in an enlarged scale of the double-reversible control mechanism for the double-reversible screwdriver and wrench combination hand tool according to the present invention.
Figure 9:
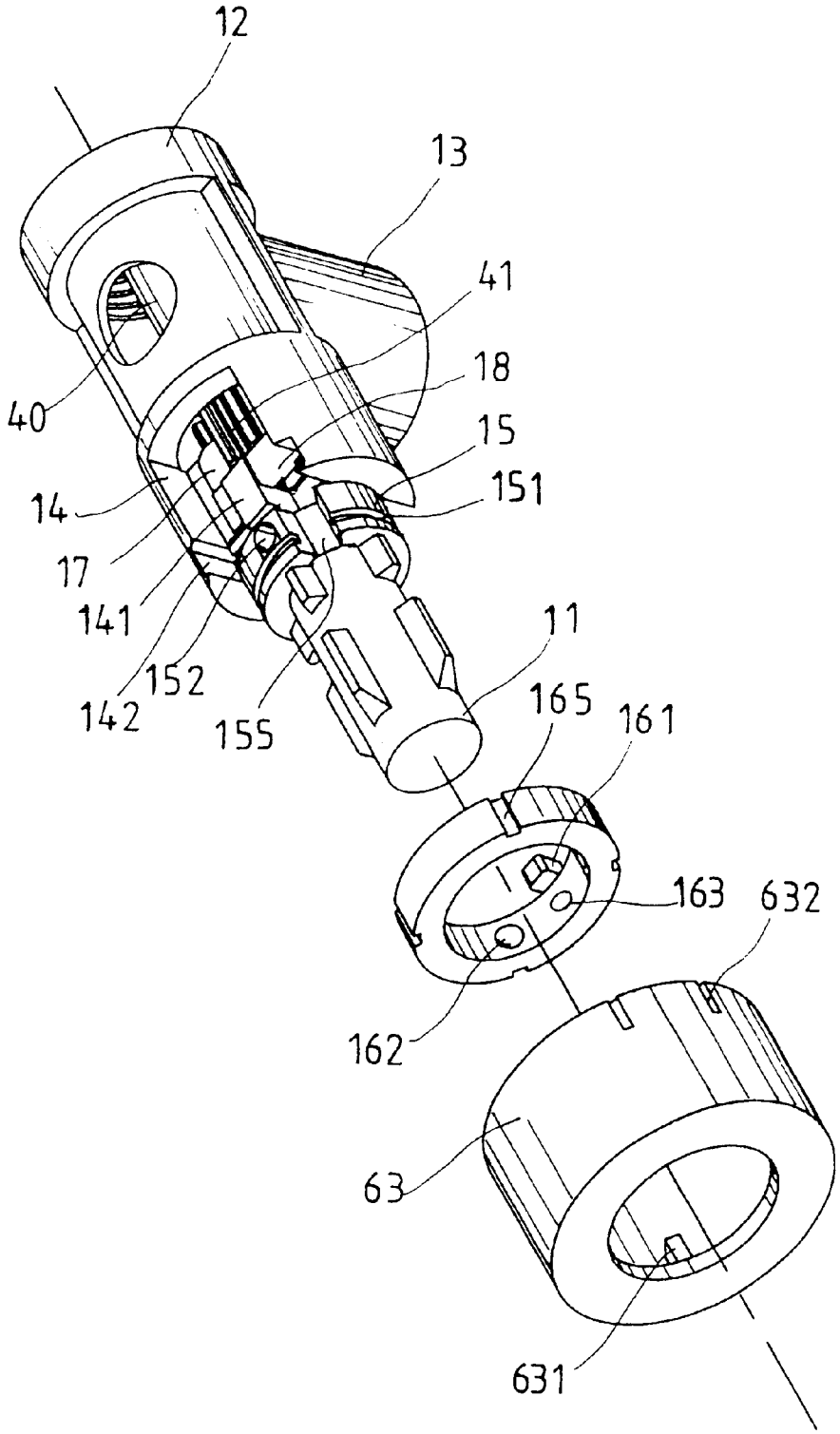
FIG. 9 is an enlarged and partially assembled view of the double-reversible control mechanism for the double-reversible screwdriver and wrench combination hand tool according to the present invention.

Referring to FIGS. 8 and 9 and FIG. 4 again, the double-reversible control mechanism 30 is comprised of a receiving chamber 14 formed in the main body 10, the fixed ratchet wheel 41 at the longitudinal spindle 40, two movable stop plates, namely, the first stop plate 17 and the second stop plate 18, a holding down spring plate 19, and a rotary wheel 16. The receiving chamber 14 is disposed in communication with the T-tube of the longitudinal tube 12 and the transverse tube 13. After installation of the longitudinal spindle 40, the fixed ratchet wheel 41 is received in the receiving chamber 14. The stop plates 17 and 18 are disposed at two opposite sides of the fixed ratchet wheel 41 in the receiving chamber 14. The holding down spring plate 19 is fastened to an invertedly extended L-shaped holder 141 inside the receiving chamber 14 to hold down the stop plates 17 and 18, having positioning flanges 191 secured to a relatively broader area 142 of the receiving chamber 14. A C-shaped clamp 156 is fastened to an outside annular groove 151 on a cylindrical bearing portion 15 at the main body 10 to secure the rotary wheel 16 in place, enabling the rotary wheel 16 to be rotated on the cylindrical bearing portion 15 at the main body 10. The main body 10 further comprises a recessed hole 152 and an opening 155 respectively disposed adjacent to the cylindrical bearing portion 15. The recessed hole 152 receives a spring element 153 and a steel ball 154 supported on the spring element 153. The spring element 153 forces the steel ball 154 into engagement with one of a plurality of recessed locating holes 162, 163 and 164 on the inside wall of the rotary wheel 16, keeping the rotary wheel 16 retained to the main body 10 in one of a series of angular positions (see also FIG. 13). The rotary wheel 16 comprises a projecting rod 161 inserted through the opening 155 into the receiving chamber 14.

Referring to FIGS. From 10 through 12, when rotating the rotary wheel 16 in one direction to one side in the opening 155, the projecting rod 161 is pressed against the rear end 181 of the second stop plate 18, causing the second stop plate 18 to move its front end 182 away from the fixed ratchet wheel 41. At this time, the first stop plate 17 is still maintained engaged with the fixed ratchet wheel 41, and therefore the fixed ratchet wheel 41 is allowed to be rotated counter-clockwise. On the contrary, when rotating the rotary wheel 16 in the reversed direction to the other side in the opening 155, the projecting rod 161 is pressed against the first stop plate 17 to disengage the first stop plate 17 from the fixed ratchet wheel 41, enabling the fixed ratchet wheel 41 to be rotated clockwise. If the rotary wheel 16 is rotated to the middle position with the projecting rod 161 spaced between the stop plates 17 and 18, the stop plates 17 and 18 are maintained engaged with the fixed ratchet wheel 41, and the fixed ratchet wheel 41 is stopped from rotary motion relative to the main body 10.

Referring to FIGS. 4 and 5, two shells 61 and 62 are sealed together by a high-frequency heat-sealing apparatus and covered on the T-tube of the main body 10. The other shell 63 is a cylindrical shell revolvably coupled to the shells 61 and 62, having an inside projection 631 engaged into a locating groove 165 on the outside wall of the rotary wheel 16 for enabling the rotary wheel 16 to be rotated with the shell 63 by hand. Indexing ribs 632 and 621 are respectively formed on the shells 63 and 62 for quick position search when rotating the rotary the shell 63 to shift the rotary wheel 16 to one of the aforesaid three positions.

Because the aforesaid stop plates 17 and 18 are arranged in parallel at two sides of the fixed ratchet wheel 41, the total length of the double-reversible control mechanism is minimized, and the design of the transverse tube 13 at the main body 10 does not give much weight and dimension to the hand tool. The arrangement of the spring 54 lowers the precision requirement of the bevel gears 42 and 51 without affecting normal operation of the hand tool; in consequence the manufacturing cost of the double-reversible screwdriver and wrench combination hand tool is relatively reduced.

Figure 14:
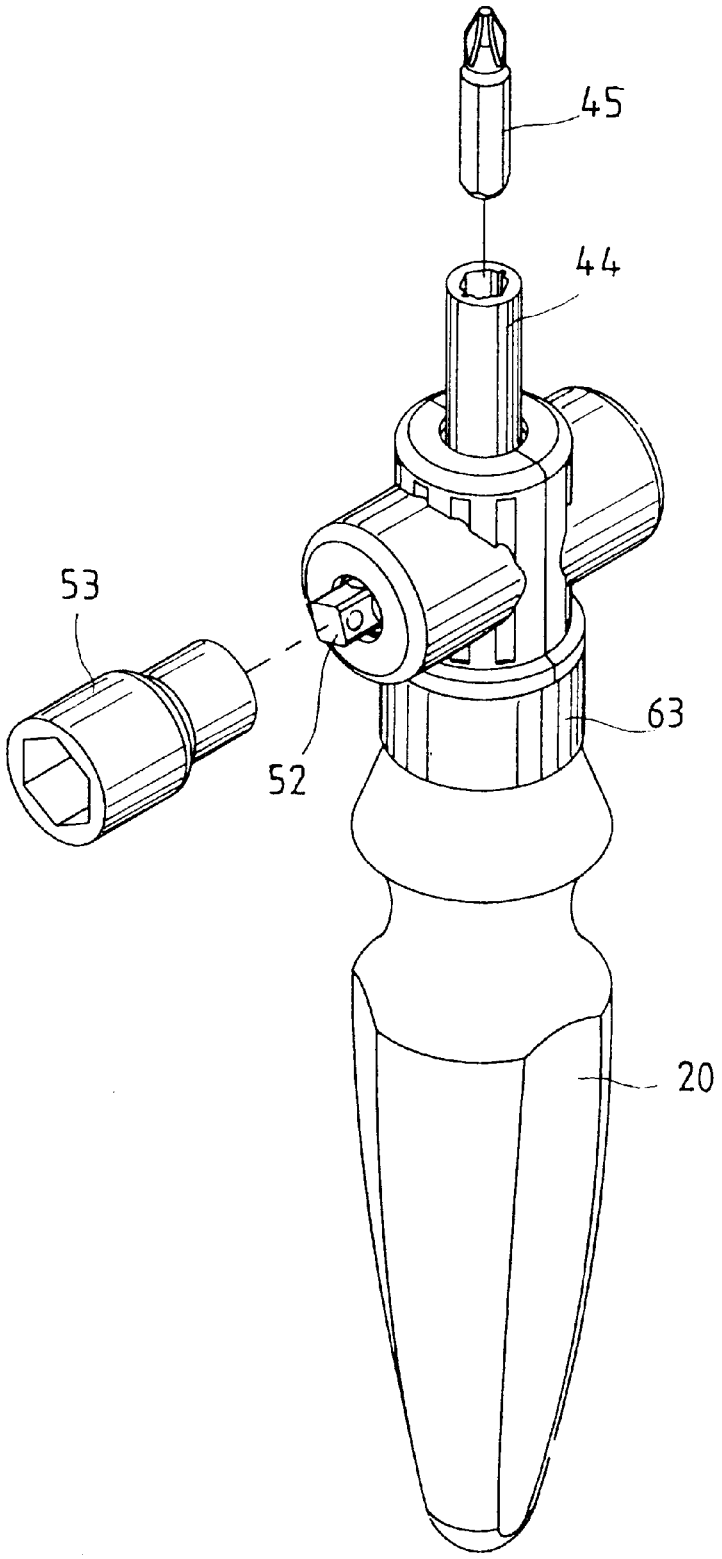
FIG. 14 illustrates an alternate form of the double-reversible screwdriver and wrench combination hand tool according to the present invention.

Referring to FIG. 14, the main body 10 can be made having a plurality of transverse tubes to hold a plurality of transverse spindles.

Figure 10:
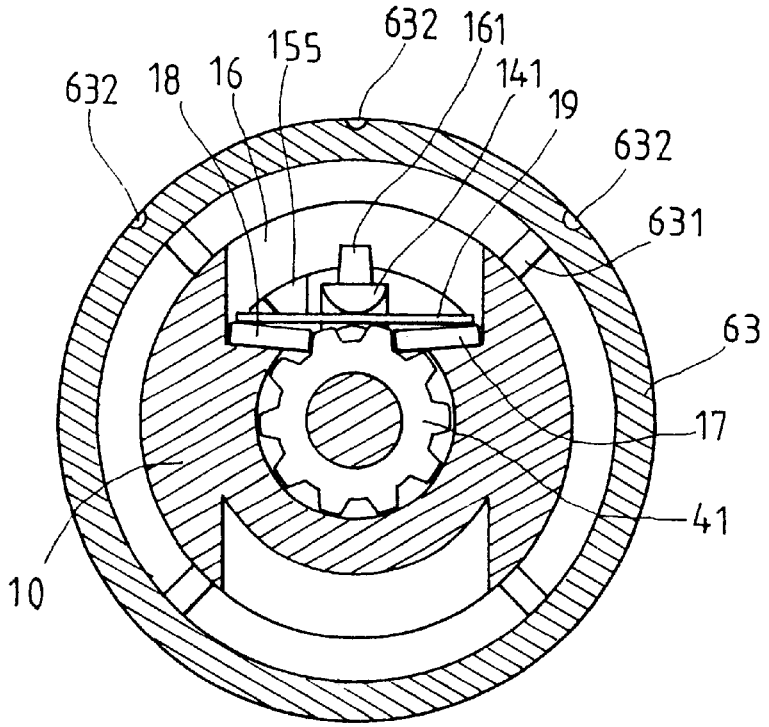
FIG. 10 is a cross-sectional view in an enlarged scale of the present invention, showing the positioning of the double-reversible control mechanism in the main body.
Figure 11:
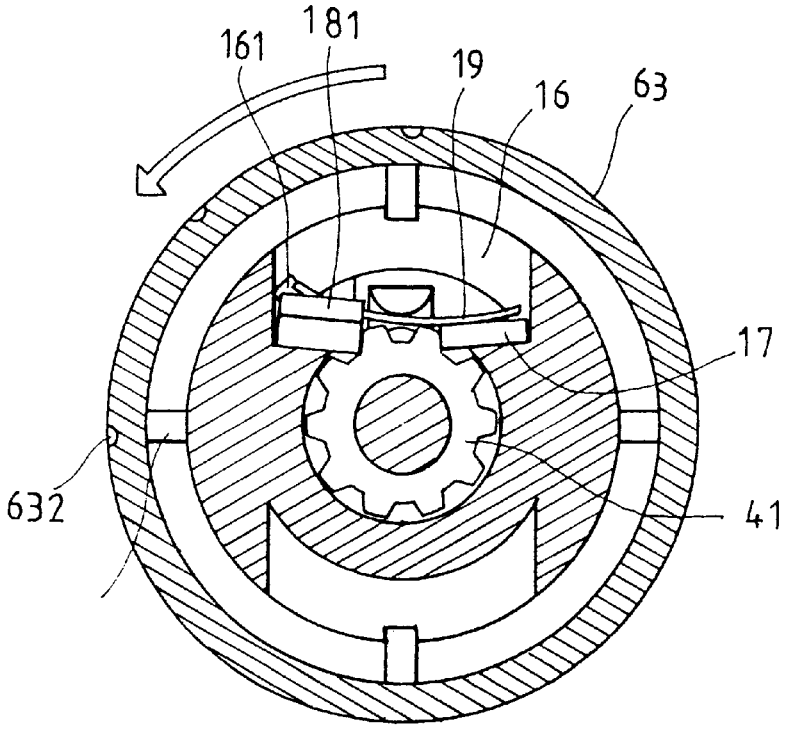
FIG. 11 is similar to FIG. 10 but showing the double reversible control mechanism operated.
Figure 12:
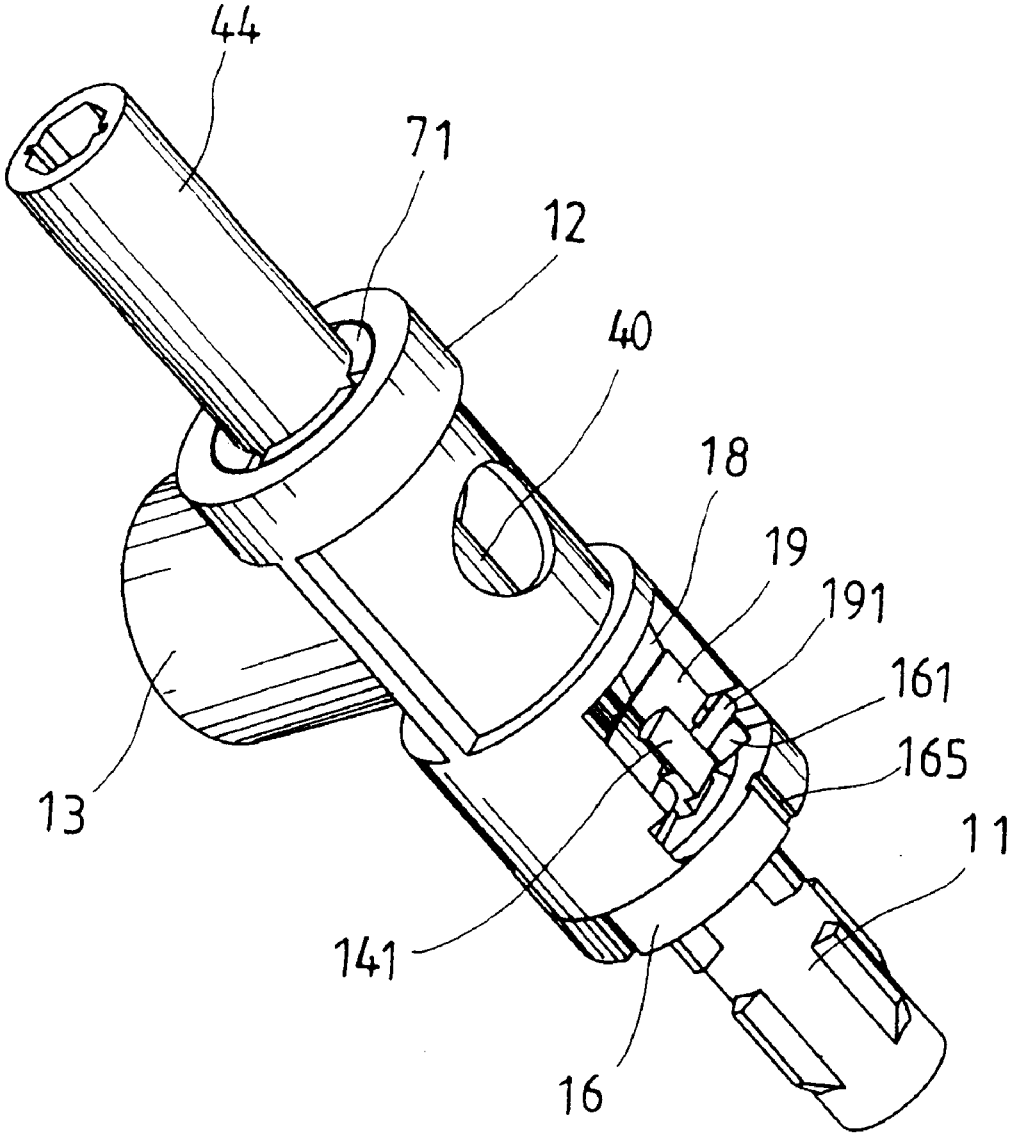
FIG. 12 is a perspective view in an enlarged scale of a part of the present invention, showing the positioning of the double-reversible control mechanism in the main body.

Referring to FIG. 10, the bottom wall of the receiving chamber 14 can be made sloping downwards from the outer side toward the center thereof, and the stop plates 17 and 18 are tilted and perpendicularly forced into engagement with the sloping teeth of the fixed ratchet wheel 41.

Figure 15:
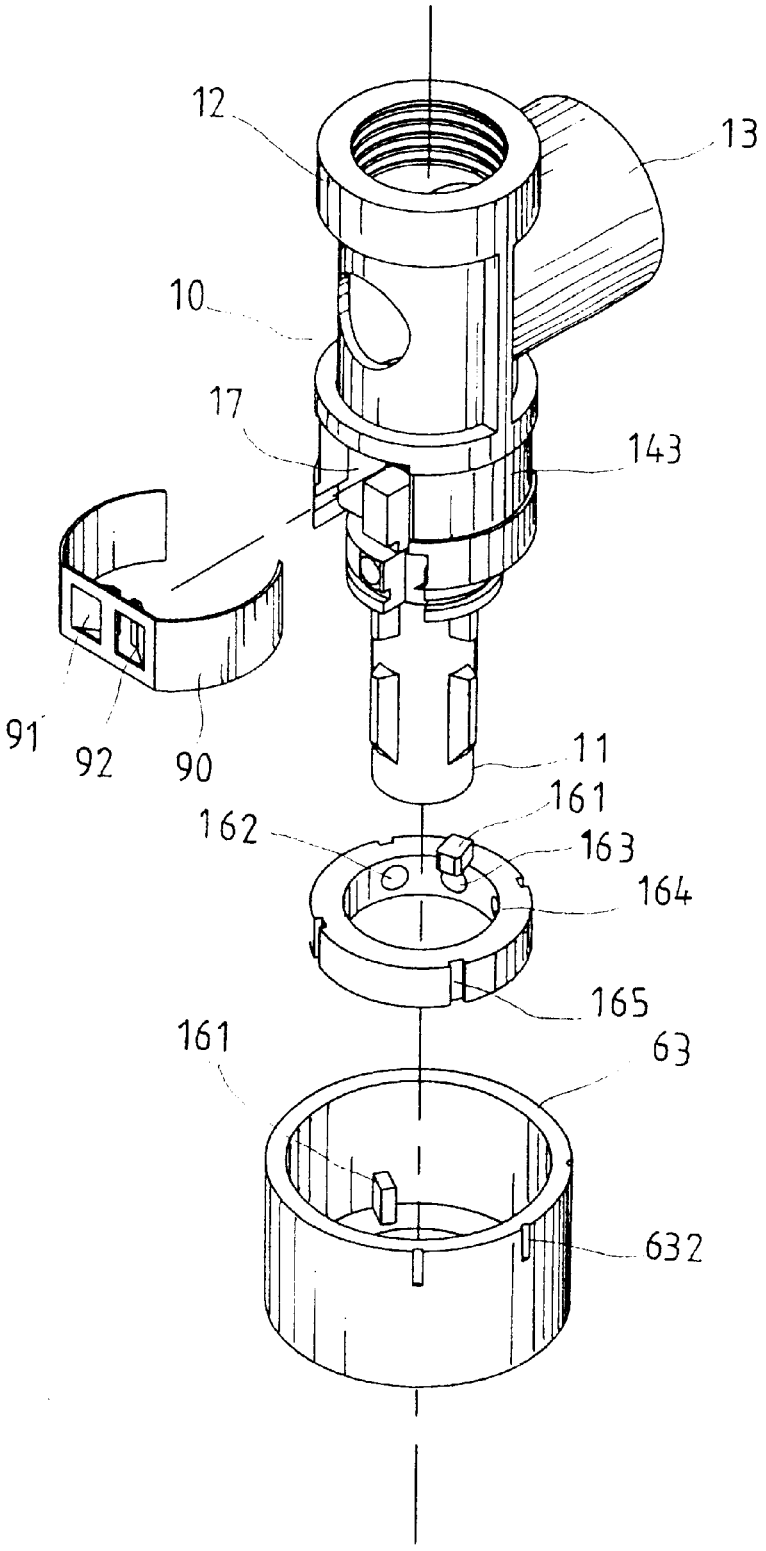
FIG. 15 is an exploded view of another alternate form of the present invention.

FIG. 15 shows an alternate form of the present invention. According to this alternate form, a spring plate 90 is mounted in an outside annular groove 143 at the periphery of the main body 10, having two protruding pressure strips 91 and 92 for pressing on the stop plates 17 and 18 respectively.

It is to be understood that the drawings are designed for purposes of illustration only, and are not intended for use as a definition of the limits and scope of the invention disclosed.

What the invention claimed is:

1. A double-reversible screwdriver and wrench combination hand tool comprising:

a handle;

a main body fastened to one end of said handle, said main body comprising a rear coupling end fastened to said handle, a front end terminating in a T-tube formed of a longitudinal tube and a transverse tube, and a receiving chamber on the middle between said rear coupling end and said front end;

a longitudinal spindle mounted in said longitudinal tube, said longitudinal spindle having a rear end terminating in a fixed ratchet wheel suspended inside said main body, and a front end terminating in a coupling portion and disposed outside said longitudinal tube;

a coupling socket coupled to the coupling portion of said longitudinal spindle to hold a screwdriver bit, enabling the screwdriver bit to be rotated with said longitudinal spindle;

a first bevel gear suspended in the receiving chamber inside said main body and rotated with said longitudinal spindle;

a transverse spindle mounted in said transverse tube and rotated with said longitudinal spindle, said transverse spindle comprising a front coupling rod extended out of said transverse tube for holding a wrench socket for turning screw bolts and nuts;

a second bevel gear fixedly provided at a rear end of said transverse spindle and meshed with said first bevel gear for synchronous rotary motion with said longitudinal spindle; and a double-reversible control mechanism provided in said main body and operated to control forward/reverse rotation of said longitudinal spindle relative to said main body.

2. The double-reversible screwdriver and wrench combination hand tool of claim 1 wherein said longitudinal tube and said transverse tube each have an inner thread, and two screw plugs are respectively threaded into the inner thread in said longitudinal tube and said transverse tube to hold said longitudinal spindle and said transverse spindle in place.

3. The double-reversible screwdriver and wrench combination hand tool of claim 2 further comprising a spring mounted on said transverse spindle and stopped between said second bevel gear and the screw plug in said transverse tube to force said second bevel into engagement with said first bevel gear.

4. The double-reversible screwdriver and wrench combination hand tool of claim 1 wherein said double-reversible control mechanism comprises a ratchet wheel fixedly mounted on said longitudinal spindle, a first stop means and a second stop means bilaterally mounted inside said receiving chamber and respectively forced into engagement with said ratchet wheel to stop said ratchet wheel from rotary motion, a holding down spring plate mounted in said main body to hold down said first stop means and said second stop means, and a rotary wheel mounted on said main body and rotated between a first position where said first stop means is released from said ratchet wheel and said second stop means is maintained engaged with said ratchet wheel for enabling said ratchet wheel to be rotated clockwise relative to said main body, a second position where said second stop means is released from said ratchet wheel and said first stop means is maintained engaged with said ratchet wheel for enabling said ratchet wheel to be rotated counter-clockwise relative to said main body, and a third position where said first stop means and said second stop means are maintained engaged with said ratchet wheel to stop said ratchet wheel from rotary motion relative to said main body, said rotary wheel having a projecting rod for moving said first stop means and said second stop means upon-rotary motion of said rotary wheel on said main body.

5. The double-reversible screwdriver and wrench combination hand tool of claim 4, wherein said first bevel gear comprises a coupling hole coupled to said ratchet wheel for enabling said longitudinal spindle to be rotated with said first bevel gear.

6. The double-reversible screwdriver and wrench combination hand tool of claim 4 wherein said holding down spring is fastened to an invertedly extended L-shaped holder inside said receiving chamber.

7. The double-reversible screwdriver and wrench combination hand tool of claim 4 wherein said holding down spring comprises positioning flange means secured to a broad area in said receiving chamber.

8. The double-reversible screwdriver and wrench combination hand tool of claim 4 wherein said double-reversible control mechanism further comprises three recessed locating holes equiangularly provided at said rotary wheel, a spring element mounted in a recessed hole on said main body, and a steel ball supported on said spring element and forced by said spring element into engagement with one of said recessed locating holes to hold said rotary wheel in one of said first position, second position and third position.

9. The double-reversible screwdriver and wrench combination hand tool of claim 4 wherein said receiving chamber having a bottom wall sloping downwards from an outer side thereof toward the center thereof, and said first top means and said second stop means are tilted and perpendicularly forced into engagement with sloping teeth of said ratchet wheel.

10. The double-reversible screwdriver and wrench combination hand tool of claim 4 wherein said holding down spring is mounted in an outside annular groove at the periphery of said main body, having two protruding pressure strips for pressing on said first stop means and said second stop means respectively.

11. The double-reversible screwdriver and wrench combination hand tool of claim 4 further comprising at least one second transverse tube formed integral with said main body, at least one second transverse spindle respectively mounted in said at least one second transverse tube and coupled to said first bevel gear by a respective bevel gear for synchronous rotary motion.

12. The double-reversible screwdriver and wrench combination hand tool of claim 1 further comprising a first shell and a second shell sealed together and covered on the T-tube of said main body, and a cylindrical third shell coupled to said first shell and said second shell and rotated on said main body.

13. The double-reversible screwdriver and wrench combination hand tool claim 12 wherein said third shell comprises an inside projection engaged into a locating groove on said rotary wheel for enabling said rotary wheel to be rotated with said third shell.

* * * * *